United States Patent [19]

Kordts et al.

[11] Patent Number: 4,866,436

[45] Date of Patent: Sep. 12, 1989

[54] DEVICE FOR TRANSMITTING MEASUREMENT VALUES OF A SENSOR

[75] Inventors: Jürgen Kordts, Wedel; Joachim W. P. Gensel, Lübeck; Gerhard Martens, Henstedt-Ulzburg, all of Fed. Rep. of Germany

[73] Assignee: U.S. Philips Corporation, New York, N.Y.

[21] Appl. No.: 132,381

[22] Filed: Dec. 15, 1987

[30] Foreign Application Priority Data

Dec. 20, 1986 [DE] Fed. Rep. of Germany ..... 3643715

[51] Int. Cl.[4] ..... G08C 19/22; G08C 19/36

[52] U.S. Cl. ..... 340/870.280; 340/870.200; 340/870.240

[58] Field of Search ..... 340/870.28, 870.16, 340/870.18, 870.20, 870.19, 870.42, 870.24, 870.39; 375/23; 455/602, 608, 612, 617

[56] References Cited

U.S. PATENT DOCUMENTS 3,717,858 2/1973 Hadden ..... 340/870.2

4,296,413 10/1981 Milkovic ..... 340/870.42

4,680,585 7/1987 Fasching ..... 340/870.19

*Primary Examiner*—Donald J. Yusko

*Assistant Examiner*—Tyrone Queen

*Attorney, Agent, or Firm*—Bernard Franzblau

[57] ABSTRACT

During the transmission of measurement values of a sensor from a transmitter circuit to a receiver circuit, for example via an optical fibre, use has been made of a device which must be activated by the receiver circuit before a measurement value can be transmitted. This is done in order to achieve potential freedom. The novel device for transmitting the sensor measurement values aims to operate faster and independently of the receiver circuit. The sensor (1) is activated by control pulses generated by a pulse generator circuit (3) and applies to the pulse generator circuit, during the occurrence of a control pulse, a measurement pulse which is dependent on the measurement value circuit. The repetition frequency and/or the width of the control pulse then depends on the amplitude value of the measurement pulses.

16 Claims, 3 Drawing Sheets

DEVICE FOR TRANSMITTING MEASUREMENT VALUES OF A SENSOR

BACKGROUND OF THE INVENTION

This invention relates to a device for transmitting, preferably via an optical fibre, measurement values of at least one sensor, which device comprises a transmitter circuit and a receiver circuit which includes an evaluation circuit.

A device of this kind transmits signals generated by a sensor from a transmitter circuit to a receiver circuit via a transmission line. For example, such a transmission line may be a coaxial cable. Preferably, the transmission line consists of an optical fibre. The electric signals generated by the sensor are converted into optical signals by a light transmitter, which optical signals are coupled into the optical fibre. The receiver circuit comprises a light receiver which converts the optical signals into electric signals again for supply to an evaluation unit. As a result of the transmission via optical fibres, the transmitted signal will not be influenced by electromagnetic interference fields.

A device of the kind set forth is known from EP-A 0 053 790, which corresponds to U.S. Pat. No. 4,346,478. The known device comprises a plurality of transmitter circuit with sensors which are capable of measuring, for example, a pressure or a temperature, by means of capacitive or resistive elements. The transmitter circuits are connected to a receiver circuit via optical fibres. Prior to the start of a measurement, the receiver circuit outputs a charge pulse whereby each time a capacitor in the transmitter circuits is charged. The energy taken up by the capacitor serves to power the other elements in a transmitter circuit during a measurement. After termination of the charge pulse, the receiver circuit outputs brief pulses in a given sequence, which pulses represent an address that are evaluated in the relevant transmitter circuits. After the subsequent appearance of a start pulse, the selected transmitter circuit starts the measurement. The transmitter circuit outputs an optical pulse whose start depends on the measurement result. It is also possible to generate a pulse where the measurement result depends on the width of the pulse. Because the transmitter circuits operate in a completely potential-free manner, the coupling in of sensor interference, for example, via an electric power supply system, is precluded. As a result of the fact that the operation is potential-free, the sensors can also be used in spaces where there is a risk of explosions. The sensors are included each time in an integrator circuit (RC member), the sensor being either a variable resistance element or a variable capacitive element. Due to this construction, use cannot be made of a four-pole sensor, for example a strain-gauge measuring bridge.

The described transmitter circuit has a complex construction because address evaluation takes place prior to each measurement. Moreover, continuous and fast transmission of measurement values is not possible because the capacitor for the energy supply in the transmitter circuit must be charged first, after which an address is evaluated and subsequently the measurement result is supplied after an integration.

SUMMARY OF THE INVENTION

Therefore, it is an object of the invention to provide a device for transmitting measurement values of at least one sensor where the transmission of measurement values is fast and independent of the receiver circuit.

In a device of the kind set forth this object is achieved in accordance with the invention in that the sensor can be activated by the control pulses generated by a pulse generator circuit, the sensor supplying the pulse generator circuit with a measurement pulse during the occurrence of a control pulse, which measurement pulse depends on the measurement values, the repetition frequency and/or width of the control pulses being dependent on the amplitude value of the measurement pulses.

In this device the sensor is activated only when a control pulse occurs. The sensor then supplies a measurement pulse which depends on the measurement result. The amplitude value of the measurement pulse corresponds to the measurement value. In the pulse generator circuit which succeeds the sensor the measurement pulses are converted into control pulses having a constant amplitude value. The repetition frequency or the width or the repetition frequency and the width of the control pulses can depend on the measurement values. In the case of a constant duty cycle (i.e. the ratio of the pulse width to the period duration), the width and the repetition frequency of the control pulses vary. In the case of a variable duty cycle, either the repetition frequency or the width of the control pulses depends on the measurement values.

The pulse generator circuit must be constructed so that it always generates control pulses in the measurement range of the sensor. It also must generate control pulses having a given width and a given repetition frequency after the activation of the device.

When the energy required for the transmitter circuit is applied by a battery, a long service life of the battery should be ensured. This can be achieved by using components having a low energy consumption, for example CMOS elements, for the construction of the transmitter circuit. When such low-energy elements are used the sensor will be the main consumer of energy. However, the energy consumption of the sensor will also be low as a result of the pulsed activation.

A further advantage of the device in accordance with the invention consists in that use can be made of four-pole sensors, for example a strain-gauge measuring bridge. In that case the two-pole input of the sensor is controlled by the control signal and the two-pole output of the sensor supplies the measurement pulse.

In a further embodiment in accordance with the invention, the pulse generator circuit comprises a detection circuit which determines the amplitude value of the measurement pulses by forming the difference between the value upon occurrence of a measurement pulse and the value during the subsequent pulse interval, the pulse generator circuit also comprising a subsequent converter circuit which generates the control pulses which depend on the respective amplitude value determined.

The detection circuit may be constructed so as to comprise a d.c. signal isolation circuit and a sample-and-hold circuit which stores the output signal of the d.c. signal isolation circuit during the occurrence of the measurement pulses. The measurement pulses supplied by the sensor contain a d.c. signal component and an a.c. signal component. Because the measurement result depends on the amplitude value of a measurement pulse, the d.c. signal is isolated in the d.c. signal isolation circuit. The amplitude value of the measurement pulse can then be related to a predetermined quantity. The output signal of the d.c. signal isolation circuit is stored in the subsequent sample-and-hold circuit. The sample-and-hold circuit is also capable of forming the mean value of the measurement values when storage takes place via an integrator circuit.

The converter circuit can be constructed so as to include a comparator which generates the control pulses and which compares a signal, supplied by a switch and corresponding to the determined amplitude value during the occurrance of the measurment pulses and to a reference value during the measurement pulse interval, with an integration signal from an integrator circuit which integrates the control pulses and which performs up-slope integration of an essentially constant first reference value during the control pulse intervals and down-slope integration of an essentially constant second reference value during the control pulses. During the control pulse interval, the integrator circuit performs up-slope integration of the comparator output signal until a reference value is reached. The comparator then generates a control pulse which is down-slope integrated by the integrator circuit. When the value is reached which corresponds to the amplitude value and which is supplied by the detection circuit, the comparator terminates the generation of the control pulse. The integrator circuit may be constructed so that the time constant during the control pulse interval is smaller than that during the control pulse. The converter circuit may also comprise, for example, a relaxation oscillator.

In a further embodiment in accordance with the invention, the pulse generator circuit is coupled to a sensor activation circuit which generates, on the basis of the control pulses, suitable activation pulses for the sensor. The sensor activation circuit converts, for example, voltage pulses into current pulses, for example, for a strain-gauge measurement bridge, or generates activation pulses having a given width.

In order to achieve a further reduction of the energy consumption, the pulse generator circuit is succeeded by a differentiating member which differentiates the control pulses. The differentiated control pulses can be applied, for example, to a light transmitter which is coupled to an optical fibre.

BRIEF DESCRIPTION OF THE DRAWINGS

Embodiments in accordance with the invention will be described in detail hereinafter with reference to the drawing, in which.

DESCRIPTION OF THE PREFERRED EMBODIMENTS

Figure 1:
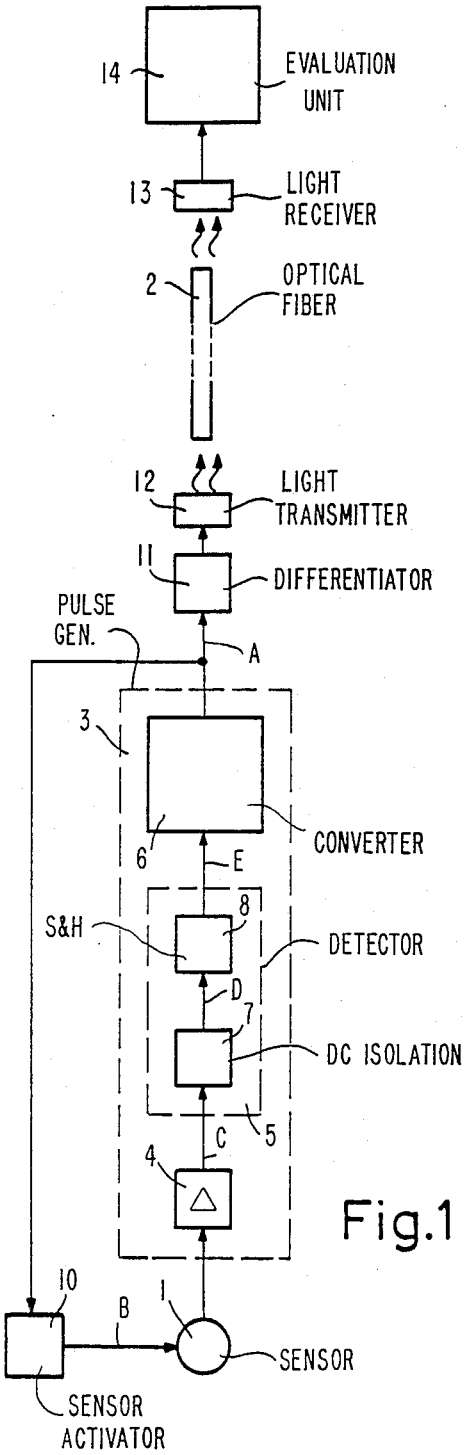
FIG. 1 shows a block diagram of a device for transmitting measurement values of a sensor via an optical fibre.

FIG. 1 shows the block diagram of a device for transmitting measurement values of a sensor 1 via an optical fibre 2. The measurement pulses supplied by the sensor 1 to a transmitter circuit are converted into optical signals which are applied to a receiver circuit via the optical fibre 2. The transmitter circuit comprises a pulse generator circuit 3 in which the measurement pulses supplied by the sensor 1 are applied, via an amplifier 4 and a subsequent detection circuit 5, to a converter circuit 6. The measurement pulses amplified in the amplifier 4 are isolated from the d.c. signal component in the d.c. signal isolation circuit 7 included in he detection circuit 5, after which they are related to another predetermined d.c. signal value. A sample-and-hold element 8, which succeeds the d.c. signal isolation circuit 7 and which is included in the detection circuit 5, stores the value of a measurement pulse until the next measurement pulse occurs.

The signal supplied by the detection circuit 5 or the sample-and-hold element 8 is converted into control pulses in the converter circuit 6. The repetition frequency or the width or the repetition frequency and the width of the control pulses depend on the output signal of the detection circuit 5. Thus, the repetition frequency and/or the width of the control pulses is a measure of the amplitude value of the measurement pulses. The control pulses are applied on the one hand to a sensor activation circuit 10 and also to a differentiator 11. The sensor activation circuit 10 forms activation pulses which are suitable for activating the sensor 1. For example, the sensor activation circuit converts voltage pulses into current pulses or changes the width of the voltage pulses.

In the differentiator 11 the control pulses are differentiated and applied to a light transmitter 12. The light transmitter 12 converts the differentiated electric control pulses into optical signals which are coupled into the optical fibre 2. The optical fibre 2 conducts the optical signals to a light receiver 13 which forms part of the receiver circuit and which converts the optical signals into electric signals again for supply as evaluation pulses to an evaluation unit 14 for further processing.

Figure 2:
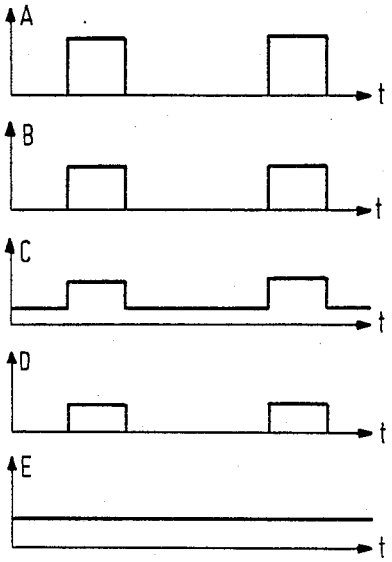
FIG. 2 shows diagrammatically signals occurring in the device shown in FIG. 1.

The operation of the device shown in FIG. 1 can be further illustrated by means of the signals diagrammatically shown in FIG. 2. The output signal of the pulse generator circuit 3 or the converter circuit 6 is formed by control pulses which are referred to as the signal A. In the sensor activation circuit 10 the signal A is converted into activation pulses which are referred to as the signal B. During the occurrence of the activation pulses, the sensor 1 outputs measurement pulses which are amplified in the amplifier 4 whose output signal is denoted as the signal C in FIG. 2. Thus, the sensor 1 issues a measurement pulse only in the presence of an activation pulse. The information concerning the measurement result or the measurement value of the measurement pulse is given by the amplitude value of the measurement pulse. In order to obtain this amplitude value, the offset present in the signal C must be removed and the amplified measurement pulses must be related to a predetermined reference value, which equals a zero in the present embodiment. The isolated signal C appears at the output of the d.c. signal isolation circuit 7 as the signal D, which is applied to the sample-and-hold element 8 and which retains the value determined during the occurrence of a measurement pulse until the subsequent measurement pulse appears. The sample-and-hold element 8 supplies a signal E which is converted into control pulses or the signal A in the converter circuit 6.

Figure 3:
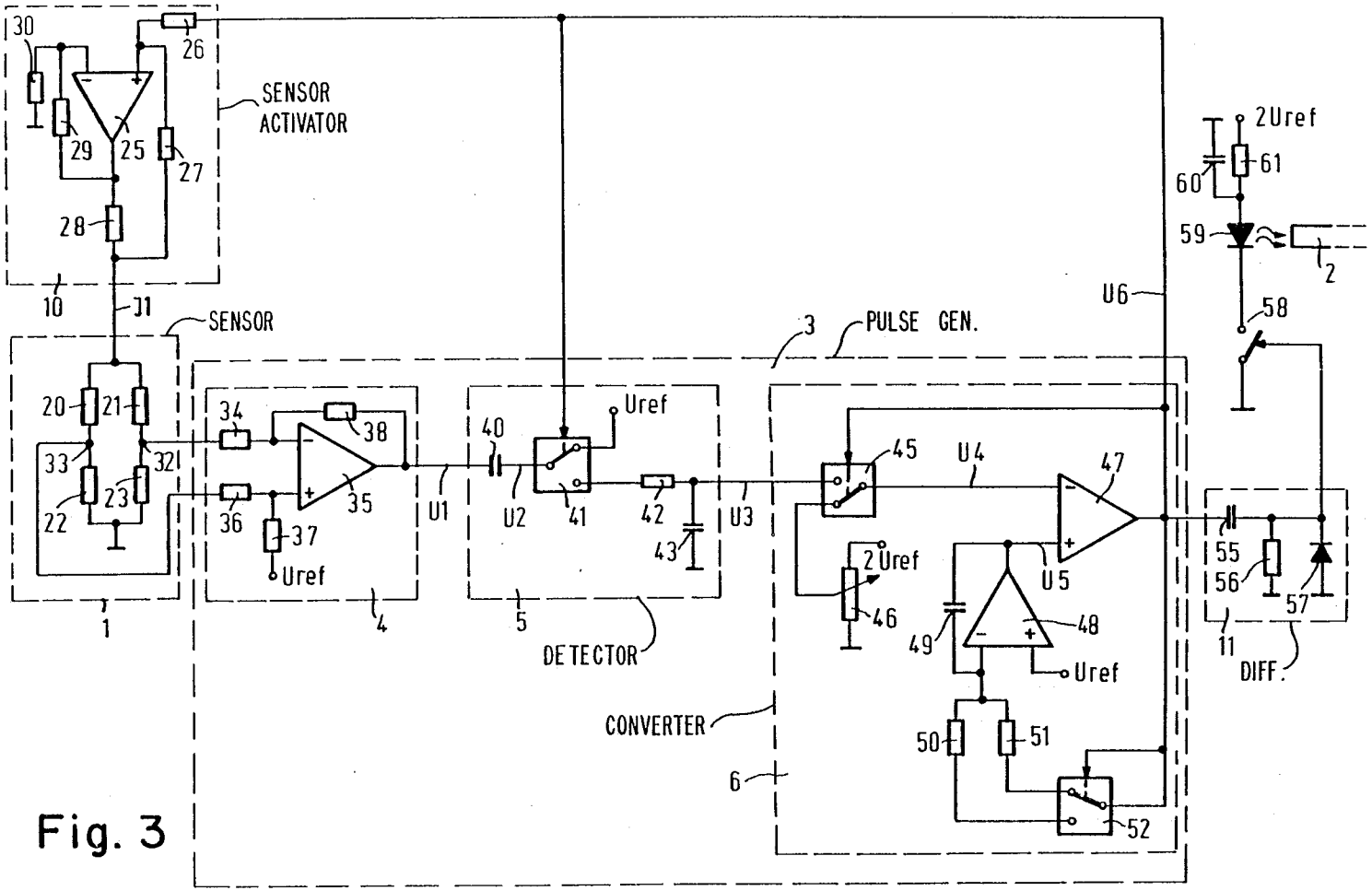
FIG. 3 shows a second, more detailed embodiment of a device for transmitting measurement values of a sensor via an optical fibre.

FIG. 3 shows a second, more detailed embodiment of a device for transmitting measurement values of a sensor 1 via an optical fibre 2. The sensor 1 of this embodiment consists of a strain-gauge measuring bridge comprising four resistors 20, 21, 22 and 23. One terminal of each of the resistors 20 and 21 is connected to the sensor activation circuit 10. The sensor activation circuit 10 comprises an operational amplifier 25, a resistor 26 being connected to the non-inverting input thereof, the other connection of said resistor bring connected to the pulse generator circuit 3. A resistor 27 is connected between the non-inverting input and the common junction of the resistors 20 and 21. A resistor 28 is connected between the output of the operational amplifier 25 and the common junction of the resistors 20 and 21. Furthermore, a resistor 29 is connected between the inverting input and the output of the operational amplifier 25. A grounded resistor 30 is connected to the inverting input of the operational amplifier 25. From the received control pulses the sensor activation circuit 10 derives current pulses II which are applied to the strain-gauge measuring bridge as activation pulses. The signal I1 is diagrammatically shown in FIG. 4.

The common junction of the resistors 22 and 23 of the strain-gauge measuring bridge is connected to ground. A first output connection 32 is formed at the common connection of the resistors 21 and 23 and a second output connection 33 of the strain-gauge measurement bridge is formed at the common connection of the resistors 20 and 22.

The connection 32 is connected to the inverting input of an operational amplifier 35 via a resistor 34, and the connection 33 is connected to the non-inverting input of the operational amplifier 35 via a resistor 36. The non-inverting input is also connected, via a resistor 37, to a reference voltage source which supplies a d.c. voltage Uref. Between the inverting inpu and the output of the operational amplifier 35 there is also connected a resistor 38. On the output of the operational amplifier 35 there is formed a signal U1 (see FIG. 4) which represents the amplified measurement pulses. The amplitude value Um of a measurement pulse, corresponding to the measurement result, is formed by the difference between the value upon occurrence of a measurement pulse and the value during the subsequent pulse interval. The elements 34 to 38 form an amplifier 4 which amplifies the measurement pulses of the strain-gauge measuring bridge to a value such that they can be simply processed in the subsequent stages.

The signal U1 is isolated in the subsequent capacitor 40 (d.c. signal isolation circuit) and related to a predetermined d.c. reference value Uref. The capacitor 40 is followed by a switch 41 which connects the capacitor to a d.c. voltage source Uref during the measurement pulse interval and to a subsequent resistor 42 during the occurrence of the measurement pulses. The switch is controlled by the control pulses because the control pulses and the measurement pulses occur substantially simultaneously. Because the capacitor 40 is connected to the d.c. voltage source Uref during the measurement pulse interval, this d.c. voltage value is superimposed on the measurement pulses (see FIG. 4, signal U2).

On the other side the resistance 42 is connected to a capacitor 43 which is connected in turn to ground. The elements 41, 42 and 43 form a sample-and-hold circuit, i.e. the value stored in the capacitor 43 during a measurement pulse is stored during the measurement pulse interval (see FIG. 4, U3). At the same time, a mean value is formed for a plurality of measurement pulses by means of the resistor 42 and the capacitor 43 which form an integrator circuit. Interference and fluctuations of the measurement value are thus substantially suppressed. The time constant of the integrator circuit depends on the choice of the resistance of the resistor 42 and the capacitance of the capacitor 43. The elements 40 to 43 described above form the detection circuit 5.

The converter circuit 6 which follows the detection circuit 5 comprises a switch 45. The switch 45 is connected to the variable tap of a potentiometer 46, one outer connection of which is connected to ground while its other outer connection is connected to a d.c. voltage source which supplies a d.c. voltage amounting to 2 Uref. The switch 45 connects the inverting input of a comparator 47 either to the output of the detection circuit 5, i.e. to the common junction of the resistor 42 and the capacitor 43, or to the variable tap of the potentiometer 46. The switch 45 is controlled by the control pulses. Thus, during the measurement pulse the output value Ua of the detection circuit 5 is present on the inverting input of the comparator 47, whereas during the measurement pulse interval a value Ue (see FIG. 4, signal U4) supplied by the potentiometer 46 is present thereon.

The output of an operational amplifier 48 and a capacitor 49 are connected to the non-inverting input of the comparator 47. The non-inverting input of the operational amplifier 48 is connected to a d.c. voltage source which supplies the d.c. voltage Uref. The inverting input is connected on the one side to the capacitor and also to the common junction of two resistors 50 and 51. The resistors 50 and 51 are connected to two different output connections of a switch 52. The input connection of the switch 52 is connected to the output of the comparator 47. The switch 52 connects on the one side the resistor 51 and on the other side the resistor 50 to the output of the comparator 47. The switch 52 is controlled by means of the control pulses.

Figure 4:
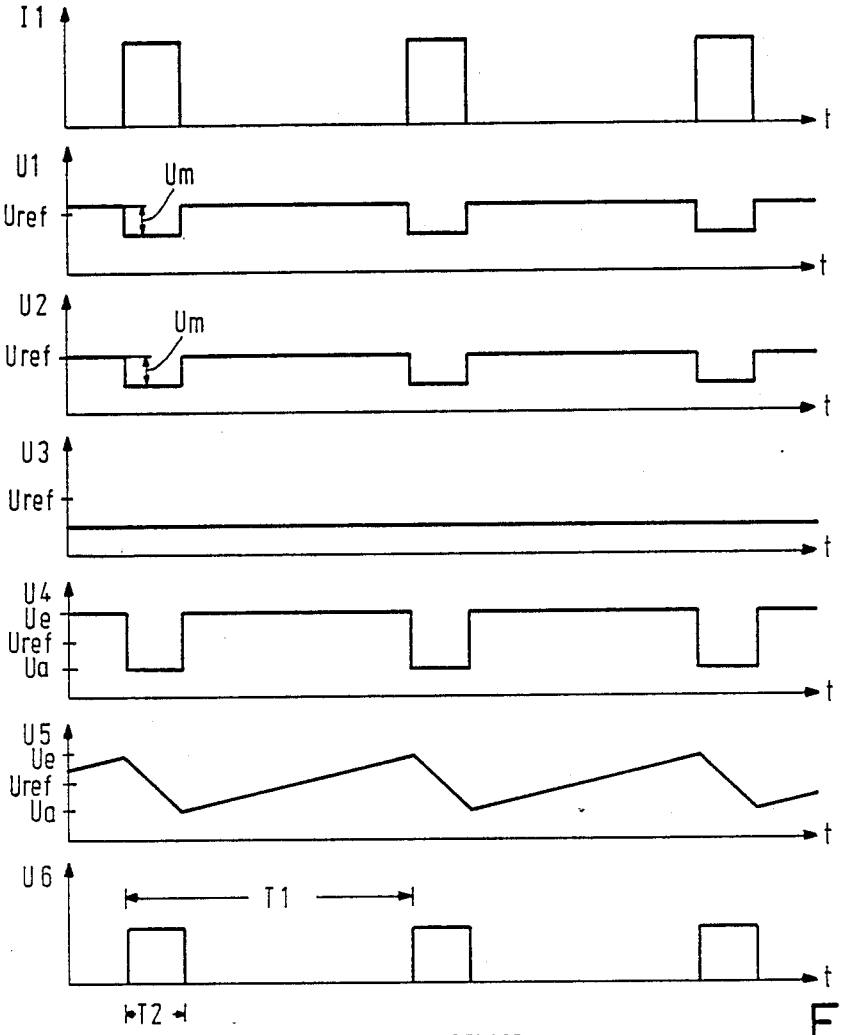
FIG. 4 shows diagrammatically signals occurring in the device shown in FIG. 3, and FIGS. 5 to 7 show various sensors suitable for use in the device shown in FIG. 3.

During a measurement pulse interval the two switches 45 and 52 occupy the positions shown in FIG. 3, i.e. the potentimeter 46 is connected to the inverting input of the comparator 47 and the output of the comparator 47 is connected to the resistor 51. The potentiometer 46 must be adjusted so that the voltage supplied thereby is higher than Uref and lower than 2 Uref. The voltage present on the output of the comparator 47 during the measurement pulse interval is up-slope integrated by the integrator circuit, composed of the elements 48 to 52, until the voltage value Ue supplied by the potentiometer 46 is reached. When this voltage vale is reached, the comparator 47 generates a control pulse which switches over the switches 45 and 52. Subsequently, the integrator circuit down-slope integrates the voltage values of the output signal of the comparator 47 until the value Ua supplied by the detection circuit 5 is reached. The comparator then terminates the generation of the control pulses. The signal U4 which is present on the output of the switch 45, the signal U5 which is present on the non-inverting input of the comparator 47, and the output signal U6 of the comparator which contains the control pulses are shown in FIG. 4. In the present embodiment the duty cycle is always the same. (The duty cycle is the ratio of pulse width to period duration). The dependency of the measurement signals on the amplitude values is realized by the width T2 and the period duration T1 of the signal U6 (see FIG. 4). The duty cycle is adjusted by way of the resistances of the resistors 50 and 51. The repetition frequency and the width of the control pulses can be influenced by readjustment of the potentiometer 46. The period duration T1 or the width T2 of the control pulses is proportional to the output signal of the detection stage 5. The voltage supplied by the potentiometer 46 must be higher than Uref in order to ensure that control pulses are generated upon activation and for the minimum measurement value.

The signals U6 are also applied to the differentiator 11 which comprises a capacitor 55 which is connected to the output of the comparator 47 and whose other connection is connected on the one side to a resistor 56, connected to ground, and also to a diode 57 which is also connected to ground. The anode of the diode 57 is connected to ground. The common junction of the capacitor 55, the resistor 56 and the diode 57 is connected to a control input of a switch 58. In the presence of a differentiated control pulse, the switch 58 is closed. The switch 58 is connected on the one side to ground and on the other side to the cathode of a lightemitting diode 59. The anode of the diode 59 is connected to a grounded capacitor 60 and to a resistor 61. The other connection of the resistor 61 is connected to a d.c. voltage source which supplies the voltage 2 Uref.

The transmitter circuit shown in FIG. 3 is powered by a battery, for example, a lithium battery, in order to ensure freedom of potential. In order to minimize the energy consumption, use should be made of energysaving elements, notably CMOS circuit elements. When such low-energy elements are used, the principal consumer of energy will be the sensor. However, the energy consumption will be very low as a result of the pulsed activation.

Figure 5:
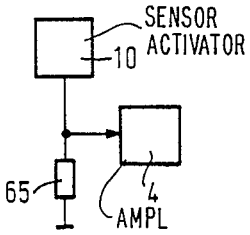

The strain-gauge measuring bridge shown in FIG. 3 forms an example of a sensor to be used. FIG. 5 shows a resistance sensor which can be used, for example for temperature measurements and its resistance varies as a function of temperature. The resistance sensor 65 is connected on the one side to ground and on the other side to the sensor activation circuit 10 and the amplifier 4. The sensor activation circuit 10 supplies the resistance sensor 65 with current pulses. Non- linearity of the resistance sensor 65 can be compensated for by a suitable, opposed gain characteristic.

Figure 6:
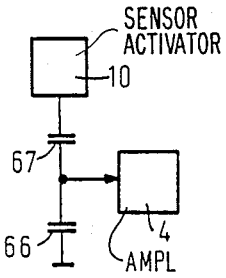

FIG. 6 shows a capacitive sensor which can be used, for example for humidity measurements and whose capacitance varies as a function of humidity. The capacitive sensor 66 is connected to a capacitor 67 and to the amplifier 4. The other connection of the capacitor 67 receives voltage pulses from the sensor activation circuit 10. The capacitive sensor 66 and the capacitor 67 form a voltage divider so that the voltage signal on the sensor depends on the output signal of this voltage divider.

Figure 7:
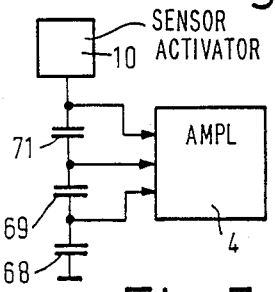

Finally, FIG. 7 shows a sensor in which three capacitors are connected in series, the two extreme capacitor representing the measurement capacitors and being, for example, elements of a differential pressure sensor. A first capacitive sensor 68 is connected on the one side to ground and on the other side to a reference capacitor 69 and to a connection of the amplifier 4 which is constructed as a summing amplifier. The other connection of the capacitor 69 is connected to a further input of the amplifier 4 and to a connection of a second capacitive sensor 71. The other connection of the capacitive sensor 71 is connected to the sensor activation circuit 10 and to a further input of the amplifier 4.

The transmitter circuit having the above construction generates optical signals which are independent of the type of sensor, i.e. standardized signals.

What is claimed is:

1. A device for transmitting measurement values of at least one sensor comprises: a transmitter circuit and a receiver circuit which includes an evaluation circuit, characterized in that the transmitter circuit includes means for intermittently activating the sensor, said activating means comprising a pulse generator circuit for generating control pulses and wherein the sensor and the pulse generator circuit are connected in a feedback loop, the sensor being activated by the control pulses for supplying the pulse generator circuit with a measurement pulse during the occurrence of a control pulse, which measurement pulse depends on the measurement values, the repetition frequency and/or width of the control pulses being dependent on the amplitude value of the measurement pulses.

2. A device as claimed in claim 1, characterized in that the pulse generator circuit comprises a detection circuit connected in cascade with a converter circuit wherein the detection circuit determines the amplitude value of the measurement pulses by forming a difference between the amplitude value upon occurrence of a measurement pulse and the amplitude value during a subsequent pulse interval, and wherein the converter circuit generates control pulses which each depend on the amplitude value determined.

3. A device as claimed in claim 2, wherein the detection circuit comprises a d.c. signal isolation circuit in cascade with a sample-and-hold circuit which stores an output signal of the d.c. signal isolation circuit during the occurrence of the measurement pulses.

4. A device as claimed in claim 3, wherein the converter circuit includes a comparator which generates the control pulses and which compares a signal, supplied by a switch and corresponding to the determined amplitude value during the occurrence of the measurement pulses and to a reference value during the measurement pulse interval, with an integration signal from an integrator circuit which integrates the control pulses and which performs up-slope integration of an essentially constant first reference value during the control pulse interval and down-slope integration of an essentially constant second reference value during the control pulses.

5. A device as claimed in claim 1 wherein the pulse generator circuit is coupled to a sensor activation circuit which generates, in response to the control pulses, suitable activation pulses for the sensor.

6. A device as claimed in claim 1 wherein the pulse generator circuit is coupled to a differentiating member which differentiates the control pulses.

7. A device as claimed in claim 2 wherein the converter circuit includes a comparator which generates the control pulses and which compares a signal, supplied by a switch and corresponding to the determined amplitude value during the occurrence of the measurement pulses and to a reference value during the measurement pulse interval, with an integration signal from an integrator circuit which integrates the control pulses and which performs up-slope integration of an essentially constant first reference value during the control puluse interval and down-slope integration of an essentially constant second reference value during the control pulses.

8. A device as claimed in claim 2 wherein the pulse generator circuit is coupled to a sensor activation circuit which generates, in response to the control pulses, activation pulses for the sensor.

9. A device as claimed in claim 8 wherein an output of the pulse generator circuit is coupled to a differentiating member which differentiates the control pulses.

10. A device as claimed in claim 1 further comprising an electro-optic converter for converting measurement pulses into corresponding light pulses, and an optical fiber for coupling said light pulses to an input of said receiver circuit.

11. A device for transmitting data representing measurement values supplied by at least one sensor comprising: a pulse generator circuit having input means for receiving measurement value signals from said sensor and output means for supplying control pulses to a receiver, and means coupled to said output means and responsive to said control pulses for activating the sensor in synchronism with the control pulses and during time intervals when the control pulses are present at said output means, whereby the sensor supplies to the pulse generator circuit measurement pulses during occurrence of the control pulses and with the measurement pulses determined by the measurement values derived by the sensor, and wherein the pulse generator circuit includes means for adjusting at least one of several parameters of the control pulses dependent on the amplitude of the measurement pulses, said parameters being repetition frequency and width of the control pulses.

12. A device as claimed in claim 11 wherein the pulse generator circuit comprises a detection circuit connected in cascade with a DC signal isolation circuit, a sample and hold circuit and a converter circuit, and wherein the converter circuit generates said control pulses.

13. A device as claimed in claim 12 wherein the converter circuit comprises, a comparator having a first input coupled selectively via a first switch to an output of the sample and hold circuit and to a source of reference voltage, an output coupled to said output means and a second input coupled to an output of an integrator circuit having an input coupled to said output means of the pulse generator circuit via a second switch, and wherein said switches are controlled by the control pulses at the output means of the pulse generator circuit.

14. A device as claimed in claim 11 wherein the pulse generator circuit comprises a detection circuit and a converter circuit connected in cascade between said input means and said output means, said device further comprising a differentiating circuit coupled to said output means, an electro-optic converter coupled to said differentiating circuit, and an optical fiber coupled to said electro-optic converter.

15. A device as claimed in claim 11 wherein the pulse generator circuit comprises a detection circuit and a converter circuit connected in cascade between said input means and said output means, and wherein the detection circuit comprises a DC isolation capacitor connected selectively via a switch to a source of reference voltage and to an integration circuit, said switch being controlled by the control pulses at the output means of the pulse generator circuit.

16. A device as claimed in claim 11 further comprising a battery located in the vicinity of said data transmitting device for supplying operating power to the pulse generator circuit, the sensor and the activating means.

* * * * *